US005770925A

United States Patent [19]

Konopka et al.

[11] Patent Number: 5,770,925

[45] Date of Patent: Jun. 23, 1998

[54] ELECTRONIC BALLAST WITH INVERTER PROTECTION AND RELAMPING CIRCUITS

[75] Inventors: John G. Konopka, Barrington; Sameer Sodhi, India, both of Ill.

[73] Assignee: Motorola Inc., Schaumburg, Ill.

[21] Appl. No.: 865,810

[22] Filed: May 30, 1997

[51] Int. Cl.[6] ..... H05B 37/02

[52] U.S. Cl. ..... 315/225; 315/127; 315/307

[58] Field of Search ..... 315/224, 225, 315/127, 307, 308, DIG. 5, 291, 209 R, 200 R

[56] References Cited

U.S. PATENT DOCUMENTS 5,010,278 4/1991 Kang .
5,047,690 9/1991 Nilssen .
5,051,661 9/1991 Lee .
5,066,894 11/1991 Klier .
5,262,699 11/1993 Sun et al. .
5,345,148 9/1994 Zeng et al. .
5,434,480 7/1995 Bobel .
5,461,287 10/1995 Russell et al. .
5,475,284 12/1995 Lester et al. .
5,479,076 12/1995 Moberg .
5,574,336 11/1996 Konopka et al. ..... 315/225

*Primary Examiner*—Benny Lee
*Assistant Examiner*—David H. Vu
*Attorney, Agent, or Firm*—Kenneth D. Labudda; Gary J. Cunningham

[57] ABSTRACT

An electronic ballast (10) for powering at least one gas discharge lamp (20) comprising an AC-to-DC converter (100), an inverter (200), an output circuit (300), a relamping circuit (400), and an inverter protection circuit (500). Protection circuit (500) shuts down the inverter (200) in response to lamp removal or lamp failure. Following replacement of a failed lamp with an operational lamp, relamping circuit (400) provides restarting of the inverter (200) and ignition of the operational lamp by momentarily disabling the inverter protection circuit (500).

27 Claims, 8 Drawing Sheets

300
302
304
306
308
70
72
74
350
330
320
242
380
700
702
704
706
720
724
726
734
736
738
60
404
502
200'
206
210
212
220
222
240'
244
246
250'
252
254
256
258
122
202
204
500'
900
902
904
906
908
910
912
914
916
918
920
922
924
926
928
930
932
934
936

ELECTRONIC BALLAST WITH INVERTER PROTECTION AND RELAMPING CIRCUITS

FIELD OF THE INVENTION

The present invention relates to the general subject of circuits for powering gas discharge lamps and, in particular, to an electronic ballast with inverter protection and relamping circuits.

BACKGROUND OF THE INVENTION

Electronic ballasts typically include an inverter that provides high frequency current for efficiently powering gas discharge lamps. Inverters are generally classified according to switching topology (e.g., half-bridge or push-pull) and the method used to control commutation of the inverter switches (e.g., driven or self-oscillating). In many types of electronic ballasts, the inverter provides a square wave output voltage. The square wave output voltage is processed by a resonant output circuit that provides high voltage for igniting the lamps and a magnitude-limited current for powering the lamps.

When the lamps fail, are removed, or otherwise cease to operate in a normal fashion, it is highly desirable that the inverter be shut down or shifted to a different mode of operation. This is necessary in order to minimize power dissipation, reduce heating in the ballast, and protect the inverter transistors from damage due to excessive voltage, current, and heat. Circuits that shut down or alter the operation of the inverter in response to lamp removal or failure are customarily referred to as inverter protection circuits.

One known type of inverter has an output arrangement in which the filaments of the lamps are "direct coupled" in series with the resonant capacitor. This approach is not attractive for those ballasts having a driven inverter because, even though removal or failure of the lamps opens the resonant circuit and thereby prevents the development of high voltage in the resonant circuit, the inverter continues to operate, resulting in unnecessary power dissipation in the inverter switches.

Several existing types of protection circuits utilize a current path through the lamp filaments to detect lamp removal or failure. This approach alone is inadequate for those situations in which a lamp fails to operate in a normal manner, but its filaments remain intact, such as what occurs with "degassed" and "diode mode" lamps. Furthermore, if multiple lamps are present, and if a single current path through the filaments of all the lamps is used, the inverter is shut down even if only one filament of one lamp fails but the remaining lamps are operational and with their filaments intact. This is unnecessary and undesirable, since it is preferred to have the inverter continue to operate so that the remaining operational lamps may continue to provide illumination, thus obviating any urgent need for replacement of the single failed lamp.

Many existing inverter protection circuits respond to a lamp fault condition by shutting down the inverter and then keeping the inverter off for as long as power is applied to the ballast. With such protection circuits, after replacement of a failed lamp with an operational lamp, it is required that power to the ballast be turned off and then on again (i.e., cycled) in order to effect ignition and powering of the lamps in the fixture which was relamped. This requirement poses a considerable inconvenience in many environments, such as large office areas or factories, in which a large number of ballasts are often connected in the same branch circuit. In such environments, it is often necessary to momentarily interrupt the lighting in a large area in order to restore desired operation to even a single lighting fixture after one or more of its lamps are replaced.

It is therefore apparent that a need exists for an inverter protection circuit that provides protection of the inverter switches and other ballast components under various lamp failure modes, such as lamp removal or a degassed lamp, and that also allows the inverter to continue to operate when at least one operational lamp is present and when the failed lamps present no danger to the inverter. In addition, a need exists for a relamping circuit that, following lamp replacement, provides ignition and powering of the lamps in an automatic manner and without any need for cycling the power to the ballast. Such circuits would represent a considerable advance over the prior art.

DETAILED DESCRIPTION OF THE PREFERRED EMBODIMENTS

Figure 1:
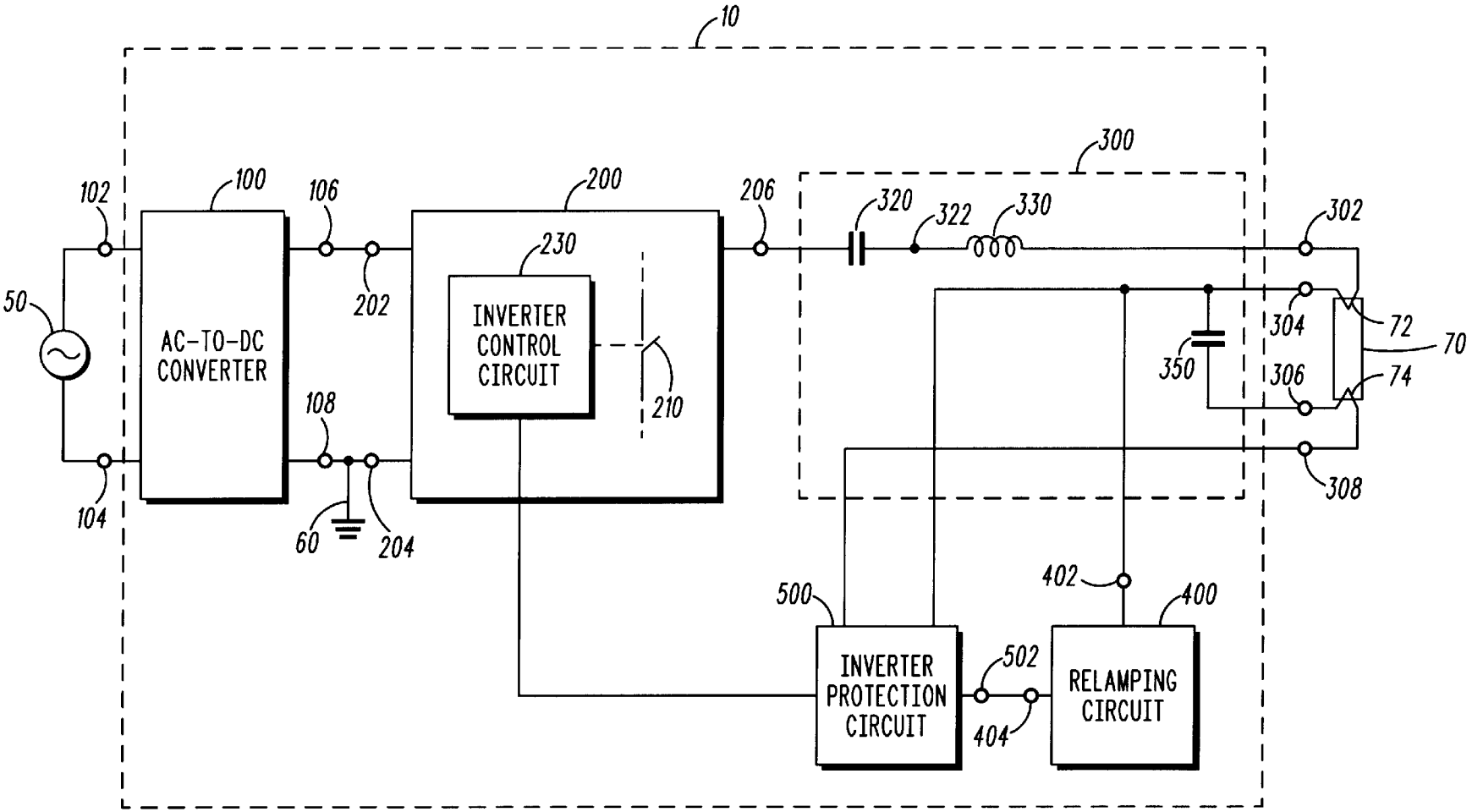
FIG. 1 is a block diagram schematic of an electronic ballast with inverter protection and relamping circuits, in accordance with the present invention.

An electronic ballast 10 for powering at least one gas discharge lamp 70 is described in FIG. 1. Ballast 10 comprises an alternating current (AC) to direct current (DC) converter 100, an inverter 200, an output circuit 300, a relamping circuit 400, and an inverter protection circuit 500. Ballast 10 also includes a plurality of output wires 302, . . . ,308 adapted to being coupled to gas discharge lamp 70. Specifically, first output wire 302 is coupleable to second output wire 304 through a first filament 72 of lamp 70, and third output wire 306 is coupleable to fourth output wire 308 through a second filament 74 of lamp 70.

AC-to-DC converter 100 includes a pair of input connections 102,104 for receiving a source of alternating current 50, and a pair of output connections 106,108. Inverter 200 comprises first and second input terminals 202,204, an output terminal 206, at least one inverter switch 210, and an inverter control circuit 230. First and second input terminals 202,204 are coupled to the output connections 106,108 of AC-to-DC converter 100. Second input terminal 204 is also coupled to a circuit ground node 60. Inverter control circuit 230 is coupled to, and is operable to commutate (i.e., turn on and off), inverter switch 210. During operation, inverter 200 provides a substantially squarewave output voltage between inverter output terminal 206 and circuit ground node 60. Inverter 200 may be implemented using any of a number of known inverter circuits, including a half-bridge inverter such as that which is disclosed in U.S. Pat. No. 5,148,087, or a single switch inverter such as that which is disclosed in U.S. Pat. No. 5,399,944.

Output circuit 300 comprises a direct current (DC) blocking capacitor 320, a resonant inductor 330, and a resonant capacitor 350. DC blocking capacitor 320 is coupled between inverter output terminal 206 and a first node 322. Resonant inductor 330 is coupled between first node 322 and first output wire 302. Resonant capacitor 350 is coupled between second output wire 304 and third output wire 306. Output circuit 300 is configured as a series resonant circuit that provides a high voltage for igniting lamp 70 and that supplies a magnitude-limited current for steady-state powering of lamp 70. Additionally, output circuit 300 is often referred to as a direct coupled arrangement, in that physical disconnection of lamp 70 from output wires 302, . . . ,308, or failure of either of the lamp filaments 72,74, disconnects resonant capacitor 350 from the rest of output circuit 300. Thus, output circuit 300 provides the advantage of automatically shutting off the resonant circuit, and therefore preventing an otherwise high voltage from developing across capacitor 350, in response to removal of, or open filaments in, lamp 70.

Inverter protection circuit 500 is coupled between inverter control circuit 230 and at least the second and fourth output wires 304,308, and includes a protection disable input 502. Inverter protection circuit 500 is operable, in response to removal or failure of lamp 70, to shut down inverter 200 by inactivating inverter control circuit 230.

Relamping circuit 400 includes a relamp detect input 402 coupled to at least second output wire 304, and a relamp detect output 404 coupled to the protection disable input 502 of inverter protection circuit 500. Relamping circuit 400 is operable, in response to replacement of a failed lamp with an operational lamp, to effect restarting of inverter 200 and ignition of the operational lamp by momentarily disabling inverter protection circuit 500. In a preferred embodiment, relamping circuit 400 is operable, in response to replacement of a failed lamp with an operational lamp, to disable inverter protection circuit 500 by coupling protection disable input 502 to circuit ground node 60.

Figure 2:
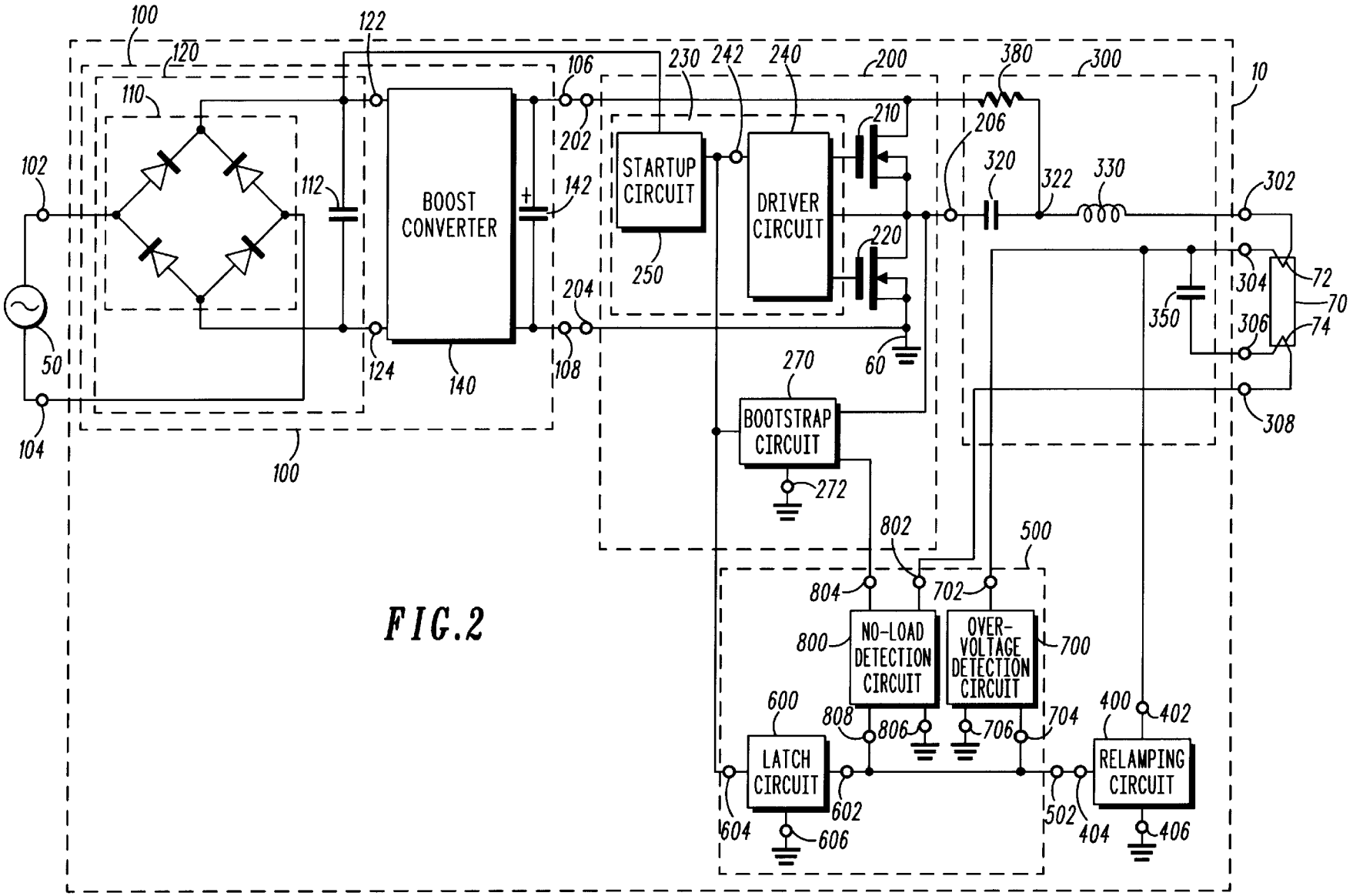
FIG. 2 describes an electronic ballast with a driven half-bridge inverter, in accordance with a preferred embodiment of the present invention.

Turning now to FIG. 2, in a preferred embodiment of ballast 10, AC-to-DC converter comprises a rectifier circuit 120 followed by a boost converter 140 and a bulk capacitor 142. Rectifier circuit 120 includes a full-wave diode bridge 110, a high frequency filtering capacitor 112, and a pair of output terminals 122,124. Boost converter 140, which is employed to provide power factor correction, line regulation, and other benefits, may be implemented as described in U.S. Pat. No. 5,148,087 and according to principles and practices well known to those skilled in the art of power supplies and electronic ballasts. Bulk capacitor 142 serves as a filtering and energy storage element for supplying a substantially DC voltage to inverter 200.

As described in FIG. 2, inverter 200 is implemented as a driven half-bridge inverter comprising a first inverter switch 210 and a second inverter switch 220. First inverter switch 210 is coupled between first input terminal 202 and output terminal 206, and second inverter switch 220 is coupled between output terminal 206 and circuit ground node 60. In a driven arrangement, inverter switches 210,220 are preferably implemented using field-effect transistors (FETs). Inverter control circuit 230 comprises a driver circuit 240, a startup circuit 250, and a bootstrap circuit 270. Driver circuit 240 is coupled to, and operable to complementarily commutate, inverter switches 210,220, and includes a DC supply input 242 for receiving operating power. Startup circuit 250 is coupled between AC-to-DC converter 100 and the DC supply input 242 of driver circuit 240, and is operable to provide power for initiating operation of driver circuit 240. Bootstrap circuit 270 is coupled between inverter output terminal 206 and DC supply input 242, and is operable to provide steady-state operating power to driver circuit 240.

Output circuit 300 further includes a DC path resistor 380 coupled between first node 322 and the first input terminal 202 of inverter 200. The function of DC path resistor 380 is to provide a circuit path whereby a modest amount of DC current is allowed to flow even when inverter 200 is off. As will be explained below, this modest amount of DC current is important to the desired operation of a preferred implementation of relamping circuit 400.

As described in FIG. 2, inverter protection circuit 500 comprises a latch circuit 600, an overvoltage detection circuit 700, and a no-load detection circuit 800. Latch circuit 600 includes a latch input 602 coupled to protection disable input 502, a latch output 604 coupled to the DC supply input 242 of driver circuit 240, and a ground connection 606 coupled to circuit ground node 60. Latch circuit 600 is operable, in response to the voltage at latch input 602 exceeding a predetermined latch threshold, to engage and to inactivate driver circuit 240 by coupling latch output 604 to circuit ground node 60. Overvoltage detection circuit 700 comprises an overvoltage detect input 702 coupled to second output wire 304, an overvoltage detect output 704 coupled to latch input 602, and a ground connection 706 coupled to circuit ground node 60. Overvoltage detection circuit 700 is operable, in response to the voltage at overvoltage detect input 702 being greater than a predetermined overvoltage threshold, to effect engagement of latch circuit 600 by providing a voltage at latch input 602 that exceeds the predetermined latch threshold. No-load detection circuit 800 includes a no-load detect input 802 coupled to fourth output wire 308, a bootstrap detect input 804 coupled to bootstrap circuit 270, a no-load detect output 808 coupled to latch input 602, and a ground connection 806 coupled to circuit ground node 60. No-load detection circuit 800 is operable, in response to the current flowing into no-load detect input 802 being less than a predetermined no-load threshold, to effect engagement of latch circuit 600 by providing a voltage at no-load detect output 808 (and, therefore, at latch input 602) that exceeds the predetermined latch threshold.

Inverter protection circuit 500 is operable, in response to removal or failure of lamp 70, to turn off driver circuit 240 by coupling DC supply input 242 to circuit ground node 60. With DC supply input 242 coupled to circuit ground node 60, driver circuit 240 is deprived of operating power and turns off. Thus, inverter protection circuit 500 prevents damage to inverter 200 by shutting down inverter 200 when lamp 70 fails or is removed. In summary, inverter protection circuit 500 is operable to shut down inverter 200 in response to one or both of the following conditions: (1) the voltage at overvoltage detect input 702 being greater than the predetermined overvoltage threshold; and (2) the current flowing into no-load detect input 802 being less than the predetermined no-load threshold. The first condition occurs when lamp 70 is degassed or in diode mode, or when lamp 70 otherwise fails to conduct current in a substantially normal manner, but only if both lamp filaments 72,74 are intact. The second condition occurs when lamp 70 is removed or when one or both of filaments 72,74 are open. Thus, protection circuit 500 protects ballast 10 under a variety of lamp fault conditions, including lamp removal, degassed lamp, and open filaments.

Figure 3:
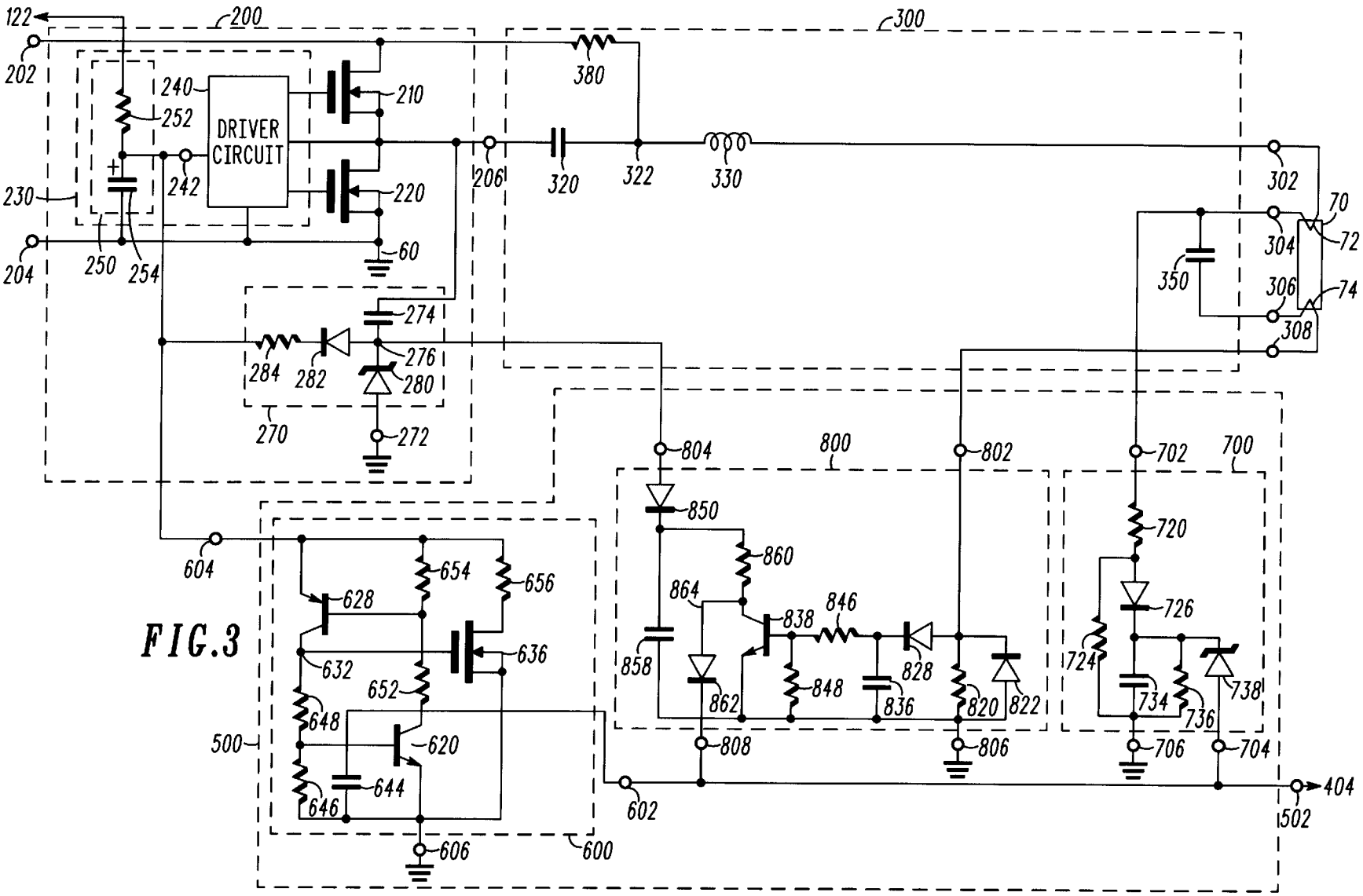
FIG. 3 is an electrical schematic diagram of the inverter, output circuit, and inverter protection circuit of the ballast described in FIG. 2, in accordance with a preferred embodiment of the present invention.

Preferred circuit implementations for startup circuit 250, bootstrap circuit 270, latch circuit 600, overvoltage detection circuit 700, and no-load detection circuit 800 are illustrated in FIG. 3. Referring first to startup circuit 250, when AC power is first applied to the ballast, capacitor 254 is initially uncharged. Consequently, driver circuit 240 (which may be implemented using any of a number of suitable devices or circuits, such as the IR2151 high-side driver integrated circuit manufactured by International Rectifier) is off and remains off until such time as the voltage at DC supply input 242 reaches a certain level. With AC power applied to the ballast, rectifier circuit 120 (see FIG. 2) provides a full-wave rectified voltage and capacitor 254 begins to charge up due to current delivered to it via resistor 252. Once the voltage across capacitor 254 reaches a certain level (e.g., 8.2 volts), driver circuit 240 turns on and, using the energy stored in capacitor 254, begins switching of inverter switches 210,220. At this point, the energy stored in capacitor 254 begins to be depleted. However, with inverter switching now taking place, bootstrap circuit 270 begins to operate and provides the steady-state power needed to keep driver circuit 240 operating. In bootstrap circuit 270, capacitor 274 serves as an AC coupling capacitor for extracting a limited amount of current from inverter output terminal 206. Zener diode 280 functions as a voltage regulator that safely limits the amount of voltage provided to the DC supply input 242 of driver circuit 240. Diode 282 serves as a rectifier for transferring only positive-going current to DC supply input 242 and for preventing discharging of capacitor 254 during negative-going portions of the inverter output voltage, while resistor 284 acts as a current limiting element. Apart from its role in initiating operation of driver circuit 240, capacitor 254 additionally serves as a filtering capacitor for storing energy provided by bootstrap circuit 270.

Referring again to FIG. 3, the detailed operation of overvoltage detection circuit 700 is now explained as follows. During operation, overvoltage detection circuit 700 monitors the voltage, $V_{OUT}$, at the second output wire 304 and provides an output voltage at overvoltage detect output 704 if $V_{OUT}$ exceeds the predetermined overvoltage threshold, $V_{HIGH}$. Conversely, as long as $V_{OUT}$ is less than $V_{HIGH}$ , no voltage is provided at output 704. Resistors 720,724 function as a voltage divider circuit for transferring a fractional portion of $V_{OUT}$ into capacitor 734 via diode 726. Diode 726 allows capacitor 734 to charge up during the positive half cycles of $V_{OUT}$ and prevents capacitor 734 from discharging during the negative half cycles of $V_{OUT}$. Zener diode 738 acts as a voltage trigger that turns on (i.e., reverse conducts) and delivers current to overvoltage detect output 704 if the voltage across capacitor 734 attempts to exceed the zener voltage, $V_Z$, of zener diode 738. The resistances of resistors 720,724 are selected so that $V_{OUT}$ exceeding $V_{HIGH}$ correspondingly causes the voltage across capacitor 734 to attempt to exceed $V_Z$. Resistors 720,724 and capacitor 734 also provide a useful RC time delay that prevents overvoltage detection circuit 700 from providing an output voltage that effects engagement of latch circuit 600 until some time after lamp 70 has first been given a reasonable period of time in which to ignite. Resistor 736 serves as a reset resistor for discharging capacitor 734 when AC power is removed from the ballast so that, upon reapplication of AC power, overvoltage detection circuit 700 provides a reasonably consistent delay period to allow for ignition of lamp 70.

The detailed operation of no-load detection circuit 800 is now explained with reference to FIG. 3 as follows. The current that flows out of third output wire 306, through second filament 74, and back into fourth output wire 308 is herein referred to as the "return current." During operation of ballast 10, no-load detection circuit 800 monitors the return current, which flows into no-load detect input 802, as an indicator of whether or not a lamp with both filaments intact is indeed connected to the ballast. A portion of the positive-going half-cycles of the return current flows to circuit ground through resistor 820, thus providing a voltage across resistor 820 that is roughly proportional to the magnitude of the return current. The negative-going half cycles of the return current flow up from circuit ground node 60 through diode 822, which serves as a bypass element for reducing the amount of power dissipated in resistor 820. If a return current is present, indicating that at least one lamp with intact filaments is connected to the ballast, capacitor 836 will charge up during the positive-going half cycles of the return current. Resistors 846,848 scale down the voltage across capacitor 836 for application to the base lead 840 of transistor 838. Once the voltage across resistor 848 becomes sufficiently high, transistor 838 turns on and remains on as long as a return current is present. With transistor 838 on, diode 862 is reverse-biased since its anode 864 is effectively coupled to near ground potential through transistor 838. Consequently, no-load detect output 808 is prevented from developing a voltage sufficient to effect engagement of latch circuit 600. If, on the other hand, no return current is present, transistor 838 does not turn on. With transistor 838 off, the voltage at bootstrap detect input 804, which develops shortly after inverter switching commences, is substantially transferred to no-load detect output 808. Consequently, latch circuit 600 becomes engaged and inactivates driver circuit 240.

Referring again to FIG. 3, the detailed operation of latch circuit 600 is now explained as follows. In response to a lamp fault condition, overvoltage detection circuit 700 and/or no-load detection circuit provide a voltage at latch input 602 that is sufficient (i.e., at least 0.7 volts or so) to cause transistor 620 to turn on. When inverter 200 is operating, latch output 604 has a voltage on the order of around 15 volts that, once transistor 620 turns on, is distributed between resistors 652,654. Consequently, the base-emitter junction of transistor 628 becomes forward-biased and transistor 628 turns on. Now, with transistor 628 on, the voltage at node 632 becomes high enough to turn on transistor 636; for improved operation of latch circuit 600, it is preferred that transistor 636 be implemented using an insulated gate enhancement mode FET, such as the 2N7002 manufactured by Motorola, Inc., that is capable of turning on, and remaining on, for relatively low values of gate-to-source voltage (e.g., on the order of about 2 volts) and drain-to-source voltage. Once transistor 636 turns on, latch output 604 is then coupled, by way of resistor 656, to circuit ground node 60, thus effectively shunting DC supply input 242 to ground and turning off driver circuit 240. Even after driver circuit 240 turns off, transistor 636 will remain on (due to current provided by startup circuit 250, which provides sufficient gate-to-source voltage to keep transistor 636 on) and actively prevent the voltage at DC supply input 242 from building up and reaching a level sufficient to initiate operation of driver circuit 240. More specifically, once engaged, latch circuit 600 will remain on until at least such time as: (i) AC power is removed from ballast 10, or (ii) relamping circuit 400 (see FIG. 2) acts to disable it.

Figure 4:
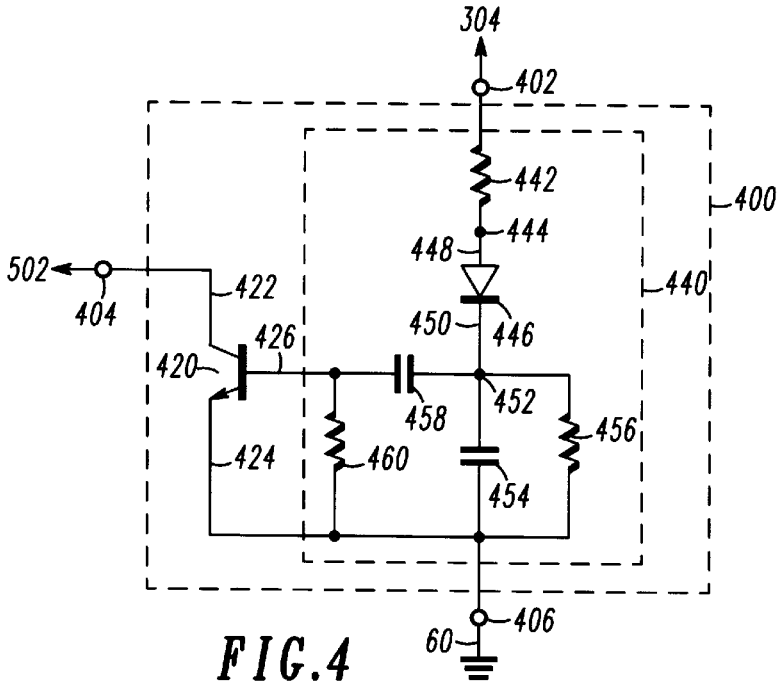
FIG. 4 is an electrical schematic diagram of the relamping circuit of the ballast described in FIG. 2, in accordance with a preferred embodiment of the present invention.

Turning now to FIG. 4, relamping circuit 400 preferably comprises a protection disable switch 420 and an impulse circuit 440. Protection disable switch 420, which is shown as a NPN type bipolar junction transistor (BJT), has a collector lead 422 coupled to relamp detect output 404, an emitter lead coupled to circuit ground node 60, and a base lead 426. When turned on, protection disable switch 420 couples protection disable input 502 to circuit ground node 60 via relamp detect output 404. Impulse circuit 440 is coupled between relamp detect input 402 and the base lead 426 of protection disable switch 426. Impulse circuit is operable, in response to replacement of a failed lamp with an operational lamp, to activate (i.e., turn on) protection disable switch 420, and thereby couple relamp detect output 404 to circuit ground node 60, for a predetermined period of time.

As described in FIG. 4, impulse circuit 440 preferably comprises a first resistor 442 coupled between relamp detect input 402 and a second node 444, a first diode 446 having an anode 448 coupled to second node 444 and a cathode 450 coupled to a third node 452, a first capacitor 454 coupled between third node 452 and circuit ground node 60 via ground connection 406, a second resistor 456 coupled between third node 452 and circuit ground node 60, a second capacitor 458 coupled between third node 452 and the base lead 426 of protection disable switch 420, and a third resistor 460 coupled between base lead 426 and circuit ground node 60.

The detailed operation of relamping circuit 400 is now explained as follows. During steady-state operation of the ballast and when lamp 70 is operating in a normal fashion, the average voltage at second output wire 304, and hence the voltage at relamp detect input 402, is essentially stable and therefore devoid of drastic fluctuations in its average value. Consequently, the voltage across capacitor 454 maintains a relatively constant value. More particularly, capacitors 454, 458 are both peak-charged and conduct little or no current. The end result is that little or no voltage is present across resistor 460 and transistor 420 is off. Thus, during normal operation of lamp 70, relamping circuit exerts no effect upon protection circuit 500.

The situation is quite different if lamp 70 fails and is then removed and replaced with a new lamp. When lamp 70 fails, protection circuit 500 is activated (i.e., latch circuit 600 becomes engaged and shuts down inverter 200). When lamp 70 is removed, relamp detect input 304 becomes open. With no source of current to sustain their respective charges, the voltages across capacitors 454,458 decay as the capacitors discharge through resistors 456,460. Within a period of time, if lamp 70 is not reinstalled or a new lamp is not installed, the voltages across capacitors 454,458 will drop to zero. When lamp 70 is subsequently reinstalled (or a new lamp is installed), the voltage at relamp detect input 304 increases at an extremely rapid rate, causing a considerable amount of current to flow into capacitors 454,458. In particular, the current flowing into capacitor 458 causes a voltage to develop across resistor 460 that is large enough (e.g., 0.7 volts or greater) to momentarily turn transistor 420 on. With transistor 420 on, relamp detect output 404, and hence protection disable input 502 (which, in turn, is coupled to latch input 602), is coupled to circuit ground node 60. This disengages latch circuit 600 and allows driver circuit 240 and inverter 200 to begin to operate. Consequently, inverter 200 will start up and remain on long enough to ignite lamp 70, if lamp 70 is indeed capable of normal ignition and operation.

Importantly, transistor 420 will remain on for only a limited period of time and preferably for only as long as it reasonably takes to restart inverter 200 and ignite the new lamp. By the end of this limited period of time, the peak value of the voltage at relamp detect input 402 stabilizes, with the result that capacitor 458 becomes peak charged. With capacitor 458 peak charged, no current flows through it and transistor 420 turns off due to insufficient drive. In this way, impulse circuit 440 turns transistor 420 on, and thereby disables protection circuit 500, for only a limited period of time. This is important since, in case a defective lamp is installed, relamping circuit 400 does not permanently disable protection circuit 500 but, after a brief delay, allows protection circuit 500 to proceed with its intended function of shutting down and protecting inverter 200 in response to a lamp fault condition.

Figure 5:
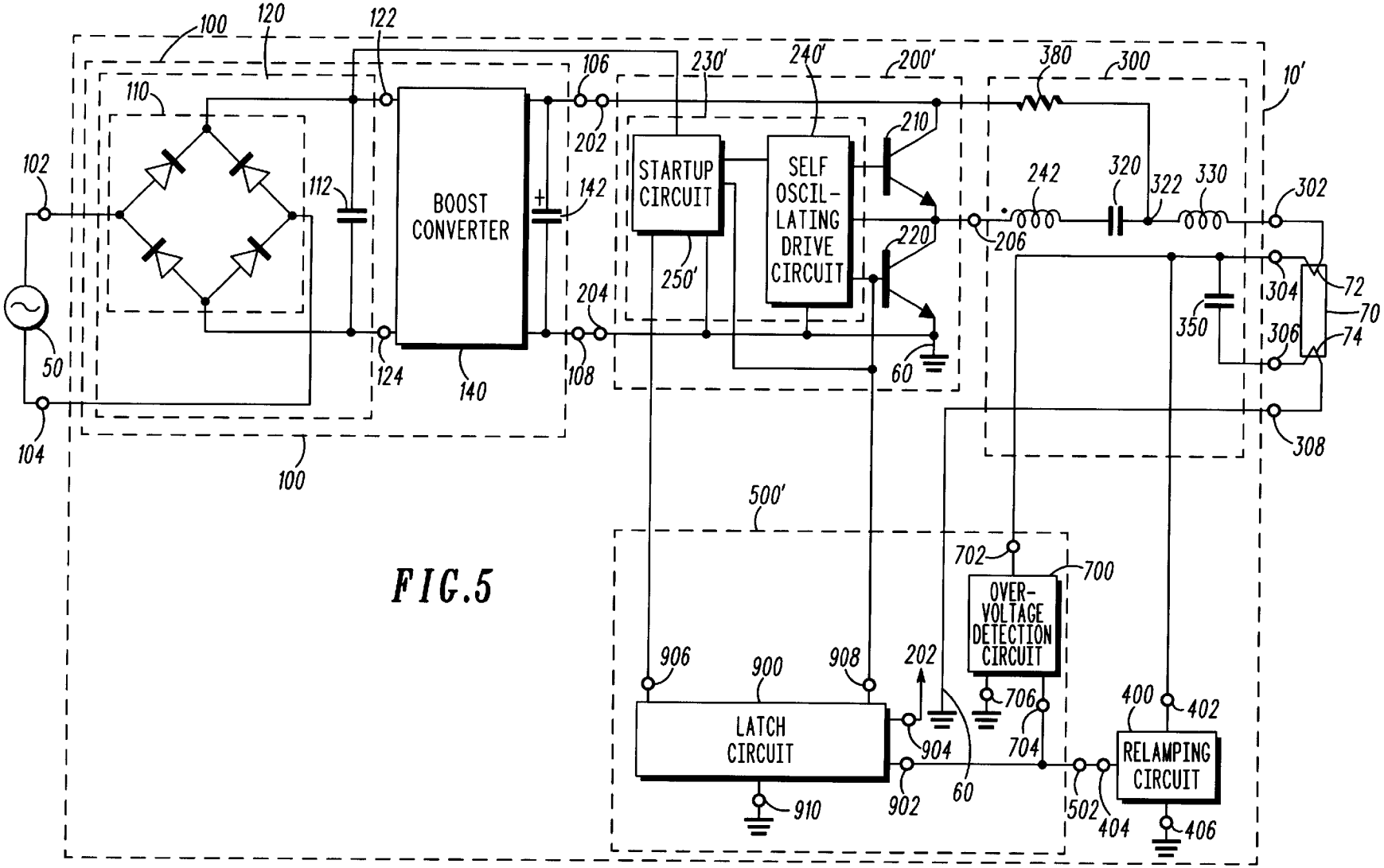
FIG. 5 describes an electronic ballast with a self-oscillating half-bridge inverter, in accordance with an alternative preferred embodiment of the present invention.

In an alternative preferred embodiment of ballast 10, as described in FIG. 5, inverter 200' is a self-oscillating half-bridge inverter. In this embodiment, inverter control circuit 230' and protection circuit 500' are considerably different from those discussed previously. For example, since inverter 200' will automatically shut off in response to removal of lamp 70 or occurrence of one or more open filaments in lamp 70, protection circuit 500' does not require a no-load detection circuit. Consequently, fourth output wire 308 is coupled directly to circuit ground node 60. Furthermore, latch circuit 900 is adapted to the somewhat more complicated task of achieving shutdown of a self-oscillating (as opposed to driven) inverter.

Figure 6:
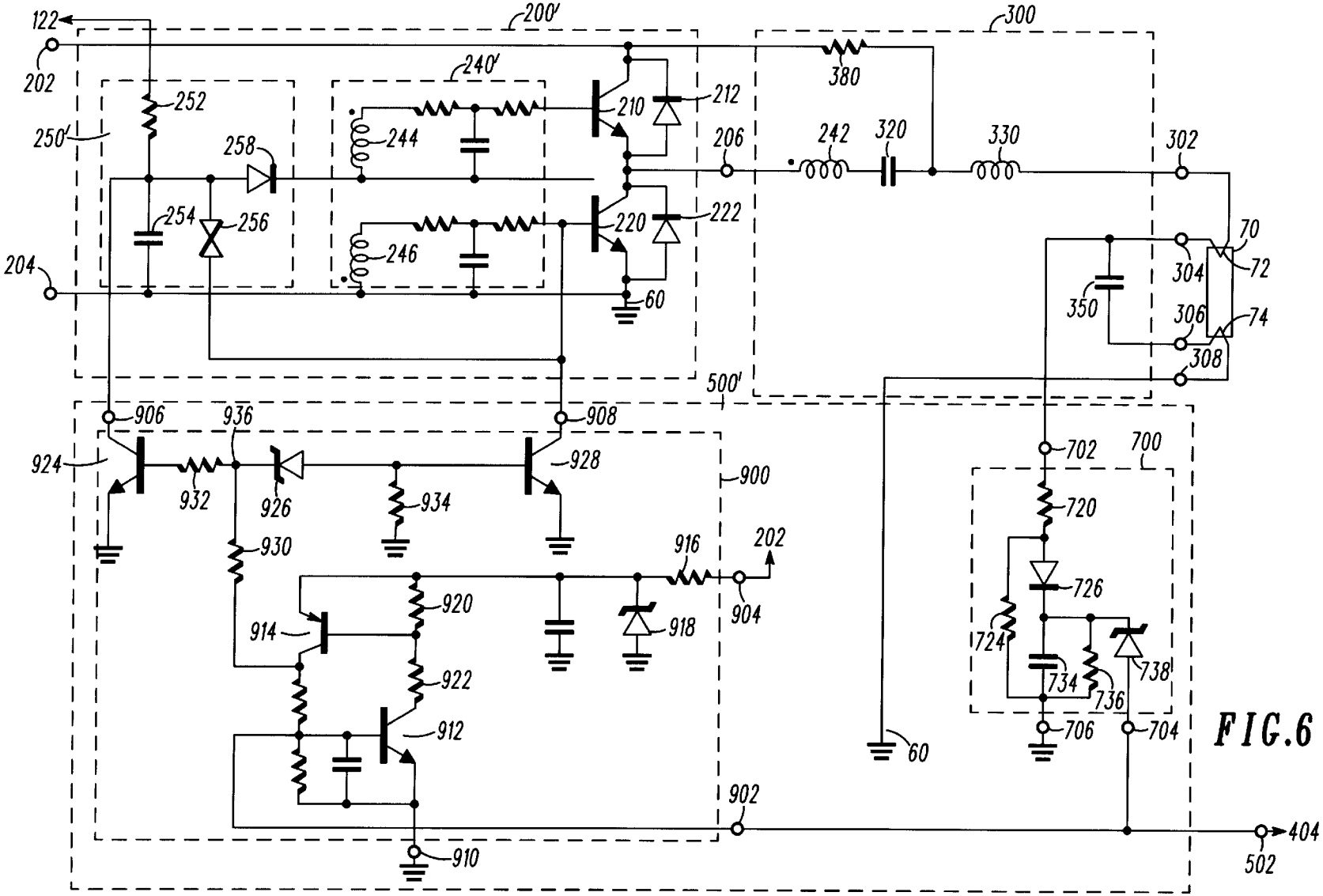
FIG. 6 is an electrical schematic diagram of the inverter, output circuit, and inverter protection circuit of the ballast described in FIG. 5, in accordance with an alternative preferred embodiment of the present invention.

As illustrated in FIG. 5, inverter control circuit 230' comprises a self-oscillating drive circuit 240' coupled to, and operable to complementarily commutate, the first and second inverter switches 210,220, and a startup circuit 250' is coupled between AC-to-DC converter 100 and second inverter switch 220. In this case, inverter switches 210,220 are preferably implemented using bipolar junction transistors. Also, as shown in FIG. 6, inverter 200' includes anti-parallel diodes 212,222 coupled in parallel with inverter switches 210,220. Referring to FIG. 5, protection circuit 500' comprises an overvoltage detection circuit 700 and a latch circuit 900. Overvoltage detection circuit 700, as well as relamping circuit 400, have the same preferred structures and functions as previously discussed with regard to FIGS. 2, 3, and 4. Latch circuit 900 comprises a latch input 902 coupled to protection disable input 502, a DC supply input 904 coupled to the first input terminal 202 of inverter 200', a first latch output 906 coupled to startup circuit 250', a second latch output 908 coupled to second inverter switch 220, and a ground connection 910 coupled to circuit ground node 60. Latch circuit 900 is operable, in response to the voltage at latch input 902 exceeding a predetermined latch threshold, to engage and to inactivate inverter control circuit 230' by coupling the first and second latch outputs 906,908 to circuit ground node 60.

Preferred circuit implementations for drive circuit 240', startup circuit 250', and latch circuit 900 are illustrated in FIG. 6. Drive circuit 240' includes a drive transformer comprising: (i) a primary winding 242 coupled in series with DC blocking capacitor 320; (ii) a first secondary winding 244 coupled to first inverter switch 210; and (iii) a second secondary winding 246 coupled to second inverter switch 220. First and second secondary windings 244,246 have opposing polarities, as illustrated by the placement of the dots on the windings in FIG. 6. Drive circuit 240' may also include associated biasing components, such as resistors and capacitors, for providing a stable base drive scheme and efficient switching of the inverter transistors. Startup circuit 250' comprises a resistor 252, a capacitor 254, a diac 256, and a diode 258. Following application of AC power to the ballast, capacitor 254 begins to charge up from rectifier circuit 120 (see FIG. 5) through resistor 252. Once the voltage across resistor 252 reaches the breakover voltage of diac 256, diac 256 turns on and, using the stored energy in capacitor 254, delivers a relatively large pulse of current into the base of second inverter transistor 220. Consequently, transistor 220 turns on, which establishes a current in the primary winding 242 of the drive transformer. This, in turn, induces a current in secondary winding 246 that provides additional energy for driving second inverter switch 220 and keeping it on. After a period of time, the currents in secondary windings 244,246 reverse in polarity, thereby effecting turn off of second inverter switch 220 and turn on of first inverter switch 210, with the eventual result that sustainable self-oscillation is established. Once complementary inverter switching is taking place, diode 258 prevents subsequent conduction of diac 256 by discharging capacitor 254 each time that the second inverter transistor 220 turns on. Various other details pertaining to the operation of a self-oscillating half-bridge inverter are discussed in U.S. Pat. Nos. 5,138,236 and 5,220,247.

The detailed operation of latch circuit 900 is now explained as follows. In response to an overvoltage condition at second output wire 304, such as what occurs with a degassed or diode mode lamp, overvoltage detection circuit provides a voltage at latch input 902 that is sufficient to cause transistor 912 to turn on. With transistor 912 on, the voltage at the DC supply input 904, which is scaled down and limited via resistor 916 and zener diode 918, is shared between resistors 920,922. Consequently, sufficient base-to-emitter voltage is supplied to turn transistor 914 on. With transistor 914 on, base current is supplied to transistor 924, which then turns on and inactivates startup circuit 250' by shorting capacitor 254. In addition, and as a result of transistor 914 being on, sufficient voltage appears at node 936 to cause zener diode 926 to reverse-conduct and thereby deliver current to the base of transistor 928. Transistor 928 then turns on and inactivates inverter 200' by shorting the base of second inverter transistor 220. In this way, latch circuit 900 not only shuts down inverter 200', but also prevents startup circuit 250' from subsequently attempting to restart inverter 200'.

As described in FIG. 6, latch circuit 900 may remain engaged for an appreciable period of time after AC power is removed from the ballast. This follows from the fact that it typically takes a considerable period of time for the voltage across bulk capacitor 142 (see FIG. 5) to decay to a low level following removal of AC power from the ballast. Consequently, if AC power is subsequently reapplied before bulk capacitor 142 has had enough time to sufficiently discharge, relamping circuit 400 will be unable to disable latch circuit 700 and, therefore, inverter 200' will be prevented from starting up and attempting to ignite lamp 70.

Figure 7:
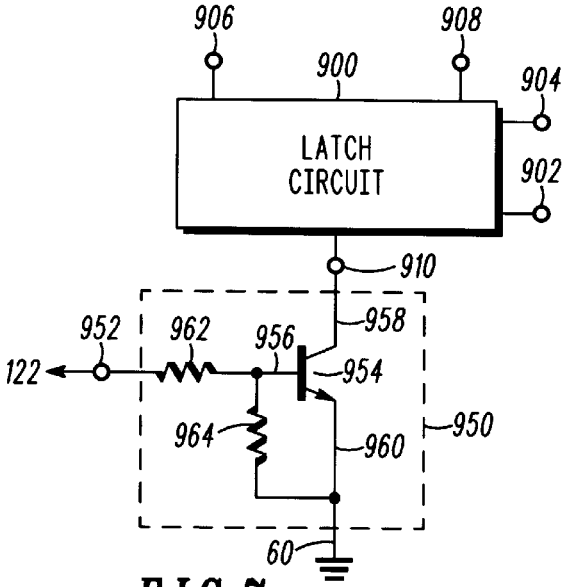
FIG. 7 describes a latch reset circuit, in accordance with an alternative embodiment of the present invention.

As illustrated in FIG. 7, inverter protection circuit 500' optionally includes a latch reset circuit 950 for rapidly disengaging latch circuit 900 following removal of AC power from the ballast. Latch reset circuit 950, interposed between the ground connection 910 of latch circuit 900 and the circuit ground node 60, includes a reset input 952 coupled to AC-to-DC converter 100. In a preferred implementation, latch reset circuit 950 comprises a reset switch 954, a first divider resistor 962, and a second divider resistor 964. Reset switch includes a base lead 956, an emitter lead 960 coupled to circuit ground node 60, and a collector lead 958 coupled to the ground connection 910 of latch circuit 900. First divider resistor 962 is coupled between reset input 952 and base lead 956, while second divider resistor 964 is couple between base lead 956 and circuit ground node 60. Reset input 952 is preferably coupled to output terminal 122 of rectifier circuit 120.

As long as AC power is being applied to the ballast, a full-wave rectified voltage is present at rectifier circuit output terminal 122 and reset switch 954 remains on. With reset switch 954 on, latch circuit 900 is free to operate as described previously. Within a very short period of time after AC power is removed from the ballast, the voltage at output terminal 122 collapses and reset switch 954 turns off due to lack of voltage. With reset switch 954 off, the ground return for latch circuit 900 is interrupted. Consequently, the holding current that ordinarily keeps latch circuit 900 engaged is prevented from flowing, with the result that latch circuit 900 turns off.

Figure 8:
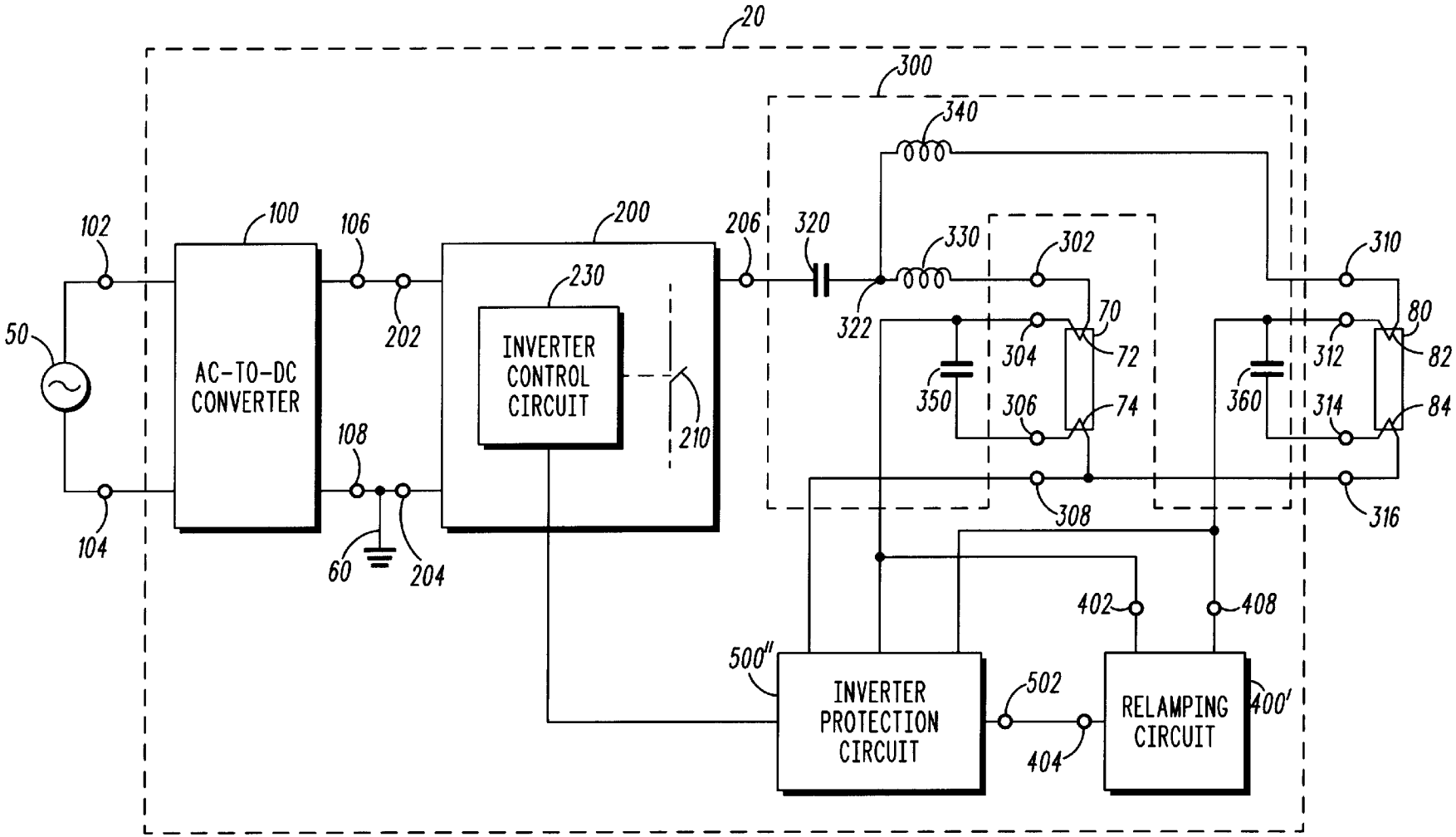
FIG. 8 is a block diagram schematic of an electronic ballast with inverter protection and relamping circuits and configured for powering multiple gas discharge lamps, in accordance with the present invention.

Appropriate modifications can be made to output circuit 300, relamping circuit 400, and overvoltage detection circuit 700 to provide a ballast 20 that is suitable for powering two or more gas discharge lamps. In one such embodiment, as illustrated in FIG. 8, output circuit 300' additionally includes a second resonant inductor 340, a second resonant capacitor 360, and a second set of output wires 310, . . . ,316 adapted to being coupled to a second gas discharge lamp 80. Second resonant inductor 340 is coupled between first node 322 and a fifth output wire 310. Second resonant capacitor 360 is coupled between a sixth output wire 312 and a seventh output wire 314. Fifth output wire 310 is coupleable to sixth output wire 312 through a first filament 82 of lamp 80, while seventh output wire 314 is coupled to eighth output wire 316 through a second filament 84 of lamp 80.

Inverter protection circuit 500" is coupled between inverter control circuit 230 and at least the second, fourth, sixth, and eighth output wires 304, 308, 312, 316 and is operable to inactivate inverter control circuit 230 in response to at least one of the following conditions: (i) removal of all of the gas discharge lamps; (ii) failure of at least one of the lamps to conduct current in a substantially normal fashion; and (iii) all of the gas discharge lamps having at least one open filament. Inverter protection circuit 500" is further operable to allow continued operation of the inverter control circuit, as long as both of the following conditions are met: (i) at least one of the lamps is operating in a substantially normal fashion and with both of its filaments intact; and (ii) if failed lamps are present, each of the failed lamps has at least one open filament. In this way, protection circuit 500" provides a high degree of protection for inverter 200 under a number of lamp failure modes, yet provides for "parallel" operation by which the remaining functional lamps are allowed to continue to operate and thus provide useful illumination if all of the failed lamps are either (i) removed; or (ii) failed, with at least one open filament.

Figure 9:
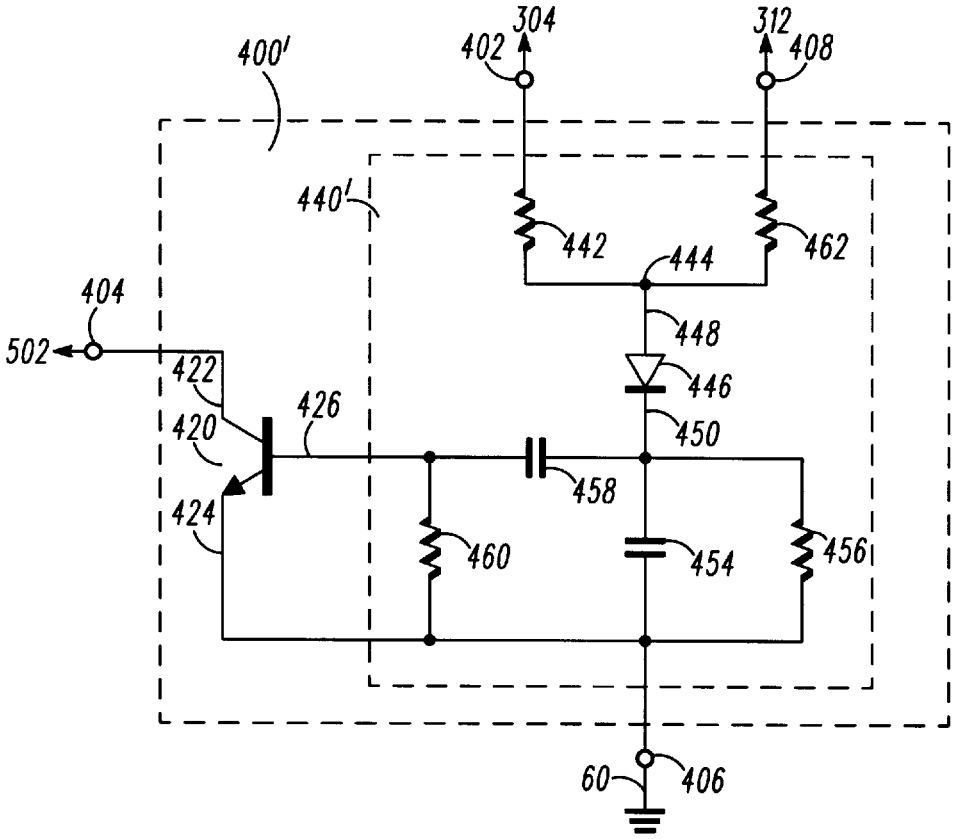
FIG. 9 is an electrical schematic diagram of a modified relamping circuit for use in the ballast described in FIG. 8, in accordance with a preferred embodiment of the present invention.

Relamping circuit 400 and overvoltage detection circuit 700 are readily modified for use in a ballast for powering two gas discharge lamps. As described in FIG. 9, relamping circuit 400' has a first relamp detect input 402 coupled to second output wire 304, and a second relamp detect input 408 coupled to sixth output wire 312 Relamping circuit 400' additionally includes a fourth resistor 462 coupled between second relamp detect input 408 and second node 444. Resistor 462 is analogous in function to resistor 442 and allows relamping circuit 400' to detect replacement of second lamp 80. As a result, relamping circuit 400' is operable to momentarily disable inverter protection circuit 500" in response to replacement of either one of the lamps.

Figure 10:
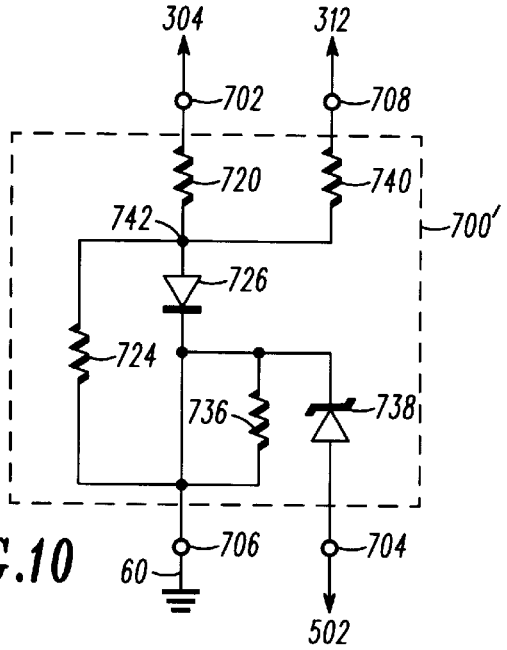
FIG. 10 is an electrical schematic diagram of a modified overvoltage detection circuit for use in the ballast described in FIG. 8, in accordance with a preferred embodiment of the present invention.

As described in FIG. 10, the overvoltage detection circuit can likewise be modified to render it suitable for use in a ballast for powering two lamps. Specifically, overvoltage detection circuit 700' additionally includes a second overvoltage detect input 708 coupled to sixth output wire 312, and a resistor 740 coupled between second overvoltage detect input 708 and the junction 742 of resistors 720,724. Resistor 740 is analogous in function to resistor 720 and allows overvoltage detection circuit 700' to monitor for overvoltage due to second lamp 80 becoming degassed or operating in the diode mode. As a result, overvoltage detection circuit 700' is operable to effect shutdown of the inverter if either one of the lamps is degassed or is operating in the diode mode with both of its filaments intact.

Although the present invention has been described with reference to a certain preferred embodiment, numerous modifications and variations can be made by those skilled in the art without departing from the novel spirit and scope of this invention.

What is claimed is:

1. An electronic ballast for powering at least one gas discharge lamp, comprising:

an AC-to-DC converter having a pair of input connections adapted to receive a source of alternating current, and a pair of output connections;

a plurality of output wires comprising first, second, third, and fourth output wires adapted to being coupled to a gas discharge lamp, wherein the first output wire is coupleable to the second output wire through a first filament of the lamp, and the third output wire is coupleable to the fourth output wire through a second filament of the lamp;

an inverter operable to provide a substantially squarewave output voltage, comprising:

first and second input terminals coupled to the output connections of the AC-to-DC converter, the second input terminal being coupled to a circuit ground node;

an output terminal;

at least one inverter switch;

an inverter control circuit coupled to, and operable to commutate, at least one inverter switch;

an output circuit, comprising:

a DC blocking capacitor coupled between the inverter output terminal and a first node;

a resonant inductor coupled between the first node and the first output wire; and a resonant capacitor coupled between the second and third output wires; and an inverter protection coupled between the inverter control circuit and at least the second and fourth output wires, the inverter protection circuit including a protection disable input and being operable, in response to removal or failure of the lamp, to shut down the inverter by inactivating the inverter control circuit; and a relamping circuit having a relamp detect input coupled to at least the second output wire, and a relamp detect output coupled to the protection disable input of the inverter protection circuit, the relamping circuit being operable, in response to replacement of a failed lamp with an operational lamp, to effect restarting of the inverter and ignition of the operational lamp by momentarily disabling the inverter protection circuit.

2. The electronic ballast of claim 1, wherein the relamping circuit is operable, in response to replacement of a failed lamp with an operational lamp, to disable the inverter protection circuit by coupling the protection disable input to the circuit ground node.

3. The electronic ballast of claim 2, wherein the relamping circuit further comprises:

a protection disable switch having a collector lead coupled to the relamp detect output, an emitter lead coupled to the circuit ground node, and a base lead; and an impulse circuit coupled between the relamp detect input and the base lead of the protection disable switch, the impulse circuit being operable, in response to replacement of a failed lamp with an operational lamp, to activate the protection disable switch, and thereby couple the relamp detect output to the circuit ground node, for a predetermined period of time.

4. The electronic ballast of claim 3, wherein:

the output circuit further comprises a DC path resistor coupled between the first node and the first input terminal of the inverter;

the impulse circuit comprises:

a first resistor coupled between the relamp detect input and a second node;

a first diode having an anode coupled to the second node and a cathode coupled to a third node;

a first capacitor coupled between the third node and the circuit ground node;

a second resistor coupled between the third node and a circuit ground node;

a second capacitor coupled between the third node and the base lead of the protection disable switch; and a third resistor coupled between the base lead of the protection disable switch and the circuit ground node; and the protection disable switch comprises a NPN-type bipolar junction transistor.

5. The electronic ballast of claim 1, wherein the inverter is a half-bridge type inverter, further comprising:

a first inverter switch coupled between the first input terminal and the output terminal; and a second inverter switch coupled between the output terminal and the circuit ground node.

6. The electronic ballast of claim 5, wherein the first and second inverter switches each comprise at least one of a bipolar junction transistor and a field effect transistor.

7. The electronic ballast of claim 5, wherein the inverter control circuit comprises:

a driver circuit coupled to, and operable to complementarily commutate, the first and second inverter switches, the driver circuit including a DC supply input for receiving operating power;

a startup circuit coupled between the AC-to-DC converter and the DC supply input of the driver circuit, the startup circuit being operable to provide power for initiating operation of the driver circuit; and a bootstrap circuit coupled between the inverter output terminal and the DC supply input of the driver circuit, the bootstrap circuit being operable to provide steady-state operating power to the driver circuit.

8. The electronic ballast of claim 7, wherein the inverter protection circuit further comprises:

a latch circuit having a latch input coupled to the protection disable input, a latch output coupled to the DC supply input of the inverter driver circuit, and a ground connection coupled to the circuit ground node, the latch circuit being operable, in response to the voltage at the latch input exceeding a predetermined latch threshold, to engage and to inactivate the inverter driver circuit by coupling the latch output to the circuit ground node;

an overvoltage detection circuit having an overvoltage detect input coupled to the second output wire, a ground connection coupled to the circuit ground node, and an overvoltage detect output coupled to the latch input, the overvoltage detection circuit being operable, in response to the voltage at the overvoltage detect input being greater than a predetermined overvoltage threshold, to effect engagement of the latch circuit by providing a voltage at the latch input that exceeds the predetermined latch threshold; and a no-load detection circuit having a no-load detect input coupled to the fourth output wire, a bootstrap detect input coupled to the bootstrap circuit, a no-load detect output coupled to the latch input, and a ground connection coupled to the circuit ground node, the no-load detection circuit being operable, in response to the current flowing into the no-load detect input being less than a predetermined no-load threshold, to effect engagement of the latch circuit by providing a voltage at the no-load detect output that exceeds the predetermined latch threshold.

9. The electronic ballast of claim 8, wherein:

the voltage at the overvoltage detect input exceeds the predetermined overvoltage threshold in response to:

(i) both lamp filaments beings intact; and (ii) failure of the lamp to conduct current in a substantially normal fashion; and the current flowing into the no-load detect input falls below the predetermined no-load threshold in response to at least one of:

(i) removal of the lamp; and (ii) failure of at least one filament of the lamp.

10. The electronic ballast of claim 5, wherein the inverter control circuit comprises:

a self-oscillating drive circuit coupled to, and operable to complementarily commutate, the first and second inverter switches, the drive circuit including a drive transformer comprising: (i) a primary winding coupled in series with the DC blocking capacitor; (ii) a first secondary winding coupled to the first inverter switch; and (iii) a second secondary winding coupled to the second inverter switch, wherein the first and second secondary windings have opposing polarities; and a startup circuit coupled between the AC-to-DC converter and the second inverter switch, the startup circuit being operable to provide power for initiating operation of the inverter.

11. The electronic ballast of claim 10, wherein the fourth output wire is coupled to the circuit ground node, and the inverter protection circuit further comprises:

a latch circuit having a latch input coupled to the protection disable input, a DC supply input coupled to the first input terminal of the inverter, a first latch output coupled to the startup circuit, a second latch output coupled to the second inverter switch, and a ground connection coupled to the circuit ground node, the latch circuit being operable, in response to the voltage at the latch input exceeding a predetermined latch threshold, to engage and to inactivate the inverter control circuit by coupling the first and second latch outputs to the circuit ground node; and an overvoltage detection circuit having an overvoltage detect input coupled to the second output wire, an overvoltage detect output coupled to the latch input, and a ground connection coupled to the circuit ground node, the overvoltage detection circuit being operable, in response to the voltage at the overvoltage detect input being greater than a predetermined overvoltage threshold, to effect engagement of the latch circuit by providing a voltage at the latch input that exceeds the predetermined latch threshold.

12. The electronic ballast of claim 11, wherein the voltage at the overvoltage detect input exceeds the predetermined overvoltage threshold in response to:

(i) both lamp filaments beings intact; and (ii) failure of the lamp to conduct current in a substantially normal fashion.

13. The electronic ballast of claim 11, wherein the inverter protection circuit further comprises a latch reset circuit interposed between the ground connection of the latch circuit and the circuit ground node, the latch reset circuit having a reset input coupled to the AC-to-DC converter and being operable to disengage the latch circuit in response to removal of AC power from the ballast.

14. The electronic ballast of claim 13, wherein:

the AC-to-DC converter further comprises a rectifier circuit operable to receive the source of alternating current and to provide a rectified voltage between a pair of rectifier circuit output terminals; and the latch reset circuit comprises:

a reset switch having a base lead, an emitter lead coupled to the circuit ground node, and a collector lead coupled to the ground connection of the latch circuit;

a first divider resistor coupled between the reset input and the base lead of the reset switch, the reset input being coupled to one of the output terminals of the rectifier circuit; and a second divider resistor coupled between the base lead of the reset switch and the circuit ground node.

15. An electronic ballast for powering at least two gas discharge lamps, comprising:

an AC-to-DC converter having a pair of input connections adapted to receive a source of alternating current, and a pair of output connections;

a first set of output wires comprising first, second, third, and fourth output wires adapted to being coupled to a first gas discharge lamp, wherein:

the first output wire is coupleable to the second output wire through a first filament of the first lamp; and the third output wire is coupleable to the fourth output wire through a second filament of the first lamp;

a second set of output wires comprising fifth, sixth, seventh, and eighth output wires adapted to being coupled to a second gas discharge lamp, wherein:

the fifth output wire is coupleable to the sixth output wire through a first filament of the second lamp; and the seventh output wire is coupleable to the eighth output wire through a second filament of the second lamp, the eighth output wire being coupled to the fourth output wire;

an inverter operable to provide a substantially squarewave output voltage, comprising:

first and second input terminals coupled to the output connections of the AC-to-DC converter, the second input terminal being coupled to a circuit ground node;

an output terminal;

at least one inverter switch; and an inverter control circuit coupled to, and operable to commutate, at least one inverter switch;

an output circuit comprising:

a DC blocking capacitor coupled between the inverter output terminal and a first node;

a first resonant inductor coupled between the first node and the first output wire;

a second resonant inductor coupled between the first node and the fifth output wire;

a first resonant capacitor coupled between the second and third output wires; and a second resonant capacitor coupled between the sixth and seventh output wires;

an inverter protection circuit coupled between the inverter control circuit and at least the second, fourth, sixth, and eighth output wires, the inverter protection circuit including a protection disable input and being operable to:

(a) inactivate the inverter control circuit in response to at least one of: (i) removal of all of the gas discharge lamps; (ii) failure of at least one of the gas discharge lamps to conduct current in a substantially normal fashion; and (iii) all of the gas discharge lamps having at least one open filament; and (b) allow continued operation of the inverter control circuit, as long as: (i) at least one of the lamps is operating in a substantially normal fashion and with both of its filaments intact; and (ii) each of the failed lamps has at least one open filament; and a relamping circuit having a first relamp detect input coupled to the second output wire, a second relamp detect input coupled to the sixth output wire, and a relamp detect output coupled to the protection disable input of the inverter protection circuit, the relamping circuit being operable, in response to replacement of a failed lamp with an operational lamp, to effect restarting of the inverter and ignition of the operational lamp by momentarily disabling the inverter protection circuit, the relamping circuit comprising:

a protection disable switch having a collector lead coupled to the relamp detect output, an emitter lead coupled to the circuit ground node, and a base lead; and a impulse circuit coupled between the first and second relamp detect inputs and the base lead of the protection disable switch, the impulse circuit being operable, in response to replacement of a failed lamp with an operational lamp, to activate the protection disable switch, and to thereby couple the relamp detect output to the circuit ground node, for a predetermined period of time.

16. The electronic ballast of claim 15, wherein:

the output circuit further comprises a DC path resistor coupled between the first node and the first input terminal of the inverter;

the impulse circuit comprises:

a first resistor coupled between the first relamp detect input and a second node;

a first diode having an anode coupled to the second node and a cathode coupled to a third node;

a first capacitor coupled between the third node and the circuit ground node;

a second resistor coupled between the third node and a circuit ground node;

a second capacitor coupled between the third node and the base lead of the protection disable switch;

a third resistor coupled between the base lead of the protection disable switch and the circuit ground node; and a fourth resistor coupled between the second relamp detect input and the second node; and the protection disable switch comprises a NPN-type bipolar junction transistor.

17. The electronic ballast of claim 15, wherein the inverter is a half-bridge type inverter, further comprising:

a first inverter switch coupled between the first input terminal and the output terminal; and a second inverter switch coupled between the output terminal and the circuit ground node.

18. The electronic ballast of claim 17, wherein the first and second inverter switches each comprise at least one of a bipolar junction transistor and a field effect transistor.

19. The electronic ballast of claim 17, wherein the inverter control circuit comprises:

a driver circuit coupled to, and operable to complementarily commutate, the first and second inverter switches, the driver circuit including a DC supply input for receiving operating power;

a startup circuit coupled between the AC-to-DC converter and the DC supply input of the driver circuit, the startup circuit being operable to provide power for initiating operation of the driver circuit; and a bootstrap circuit coupled between the inverter output terminal and the DC supply input of the driver circuit, the bootstrap circuit being operable to provide steady-state operating power to the driver circuit.

20. The electronic ballast of claim 19, wherein the inverter protection circuit further comprises:

a latch circuit having a latch input coupled to the protection disable input, a latch output coupled to the DC supply input of the inverter driver circuit, and a ground connection coupled to the circuit ground node, the latch circuit being operable, in response to the voltage at the latch input exceeding a predetermined latch threshold, to engage and to inactivate the inverter driver circuit by coupling the latch output to the circuit ground node;

an overvoltage detection circuit having a first overvoltage detect input coupled to the second output wire, a second overvoltage detect input coupled to the sixth output wire, an overvoltage detect output coupled to the latch input, and a ground connection coupled to the circuit ground node, the overvoltage detection circuit being operable, in response to the voltage at either of the overvoltage detect inputs being greater than a predetermined overvoltage threshold, to effect engagement of the latch circuit by providing a voltage at the latch input that exceeds the predetermined latch threshold; and a no-load detection circuit having a no-load detect input coupled to the fourth output wire, a bootstrap detect input coupled to the bootstrap circuit, a no-load detect output coupled to the latch input, and a ground connection coupled to the circuit ground node, the no-load detection circuit being operable, in response to the current flowing into the no-load detect input being less than a predetermined no-load threshold, to effect engagement of the latch circuit by providing a voltage at the no-load detect output that exceeds the predetermined latch threshold.

21. The electronic ballast of claim 20, wherein:

the voltage at at least one of the overvoltage detect inputs exceeds the predetermined overvoltage threshold in response to at least one of the lamps: (i) failing to conduct current in a substantially normal fashion; and (ii) having both of its filaments intact; and the current flowing into the no-load detect input falls below the predetermined no-load threshold in response to at least one of: (i) all of the lamps being removed; and (ii) all of the lamps having at least one open filament.

22. The electronic ballast of claim 17, wherein the inverter control circuit comprises:

a self-oscillating drive circuit coupled to, and operable to complementarily commutate, the first and second inverter switches, the drive circuit including a drive transformer having: (i) a primary winding coupled in series with the DC blocking capacitor; (ii) a first secondary winding coupled to the first inverter switch; and (iii) a secondary winding coupled to the second inverter switch, wherein the first and second secondary windings have opposing polarities; and a startup circuit coupled between the AC-to-DC converter and the second inverter switch, the startup circuit being operable to provide power for initiating operation of the inverter.

23. The electronic ballast of claim 22, wherein the fourth output wire is coupled to the circuit ground node, and the inverter protection circuit further comprises:

a latch circuit having a latch input coupled to the protection disable input, a first latch output coupled to the startup circuit, a second latch output coupled to the second inverter switch, a DC supply input coupled to the first input terminal of the inverter, and a ground connection coupled to the circuit ground node, the latch circuit being operable, in response to the voltage at the latch input exceeding a predetermined latch threshold, to engage and to inactivate the inverter control circuit by coupling the first and second latch outputs to the circuit ground node; and an overvoltage detection circuit having a first overvoltage detect input coupled to the second output wire, a second overvoltage detect input coupled to the sixth output wire, an overvoltage detect output coupled to the latch input, and a ground connection coupled to the circuit ground node, the overvoltage detection circuit being operable, in response to the voltage at either of the overvoltage detect inputs being greater than a predetermined overvoltage threshold, to effect engagement of the latch circuit by providing a voltage at the latch input that exceeds the predetermined latch threshold.

24. The electronic ballast of claim 23, wherein the voltage at at least one of the overvoltage detect inputs exceeds the predetermined overvoltage threshold in response to at least one of the lamps: (i) failing to conduct current in a substantially normal fashion; and (ii) having both of its filaments intact.

25. The electronic ballast of claim 23, wherein the inverter protection circuit further comprises a latch reset circuit interposed between the ground connection of the latch circuit and the circuit ground node, the latch reset circuit having a reset input coupled to the AC-to-DC converter and being operable to disengage the latch circuit in response to removal of AC power from the ballast.

26. The electronic ballast of claim 25, wherein:

the AC-to-DC converter further comprises a rectifier circuit operable to receive the source of alternating current and to provide a rectified voltage between a pair of rectifier circuit output terminals; and the latch reset circuit comprises:

a reset switch having a base lead, an emitter lead coupled to the circuit ground node, and a collector lead coupled to the ground connection of the latch circuit;

a first divider resistor coupled between the rest input and the base lead of the reset switch, the reset input being coupled to one of the output terminals of the rectifier circuit; and a second divider resistor coupled between the base lead of the reset switch and the circuit ground node.

27. An electronic ballast for powering at least two fluorescent lamps, comprising:

an AC-to-DC converter having a pair of input connections adapted to receive a source of alternating current, and a pair of output connections;

a first set of output wires comprising first, second, third, and fourth output wires adapted to being coupled to a first fluorescent lamp, wherein:

the first output wire is coupleable to the second output wire through a first filament of the first lamp; and the third output wire is coupleable to the fourth output wire through a second filament of the first lamp;

a second set of output wires comprising fifth, sixth, seventh, and eighth output wires adapted to being coupled to a second fluorescent lamp, wherein:

the fifth output wire is coupleable to the sixth output wire through a first filament of the second lamp; and the seventh output wire is coupleable to the eighth output wire through a second filament of the second lamp, the eighth output wire being coupled to the fourth output wire;

a half-bridge type inverter, comprising:

first and second input terminals coupled to the output connections of the AC-to-DC converter, the second input terminal being coupled to a circuit ground node;

an output terminal;

a first inverter switch coupled between the first input terminal and the output terminal;

a second inverter switch coupled between the output terminal and the circuit ground node; and an inverter control circuit, comprising:

a driver circuit coupled to, and operable to complementarily commutate, the first and second inverter switches, the driver circuit including a DC supply input for receiving operating power;

a startup circuit coupled between the AC-to-DC converter and the DC supply input of the driver circuit, the startup circuit being operable to provide power for initiating operation of the driver circuit; and a bootstrap circuit coupled between the inverter output terminal and the DC supply input of the driver circuit, the bootstrap circuit being operable to provide steady-state operating power to the driver circuit, an output circuit comprising:

a DC blocking capacitor coupled between the inverter output terminal and a first node;

a DC path resistor coupled between the first node and the first input terminal of the inverter;

a first resonant inductor coupled between the first node and the first output wire;

a second resonant inductor coupled between the first node and the fifth output wire;

a first resonant capacitor coupled between the second and third output wires; and a second resonant capacitor coupled between the sixth and seventh output wires;

an inverter protection coupled between the inverter driver circuit and at least the second, fourth, sixth, and eighth output wires, the inverter protection circuit comprising:

a protection disable input;

a latch circuit having a latch input coupled to the protection disable input, a latch output coupled to the DC supply input of the inverter driver circuit, and a ground connection coupled to the circuit ground node, the latch circuit being operable, in response to the voltage at the latch input exceeding a predetermined latch threshold, to engage and to inactivate the inverter driver circuit by coupling the latch output to the circuit ground node;

an overvoltage detection circuit having a first overvoltage detect input coupled to the second output wire, a second overvoltage detect input coupled to the sixth output wire, an overvoltage detect output coupled to the latch input, and a ground connection coupled to the circuit ground node, the overvoltage detection circuit being operable, in response to the voltage at either of the overvoltage detect inputs being greater than a predetermined overvoltage threshold, to effect engagement of the latch circuit by providing a voltage at the latch input that exceeds the predetermined latch threshold; and a no-load detection circuit having a no-load detect input coupled to the fourth output wire, a bootstrap detect input coupled to the bootstrap circuit, a no-load detect output coupled to the latch input, and a ground connection coupled to the circuit ground node, the no-load detection circuit being operable, in response to the current flowing into the no-load detect input being less than a predetermined no-load threshold, to effect engagement of the latch circuit by providing a voltage at the no-load detect output that exceeds the predetermined latch threshold; and a relamping circuit having a first relamp detect input coupled to the second output wire, a second relamp detect input coupled to the sixth output wire, and a relamp detect output coupled to the protection disable input of the inverter protection circuit, the relamping circuit comprising:

a protection disable switch comprising a NPN-type bipolar junction transistor having a collector lead coupled to the relamp detect output, an emitter lead coupled to the circuit ground node, and a base lead;

a first diode having an anode coupled to the second node and a cathode coupled to a third node;

a first capacitor coupled between the third node and the circuit ground node;

a second resistor coupled between the third node and a circuit ground node;

a second capacitor coupled between the third node and the base lead of the protection disable switch;

a third resistor coupled between the base lead of the protection disable switch and the circuit ground node; and a fourth resistor coupled between the second relamp detect input and the second node.

* * * * *